US011903438B2

(12) United States Patent
Guazzerotti

(10) Patent No.: US 11,903,438 B2
(45) Date of Patent: Feb. 20, 2024

(54) HELMET WITH ASSOCIATED ROTATION OF CHIN GUARD AND FACE MASK

(71) Applicant: Jiangyin Dafeima Automobile Technology Co., Ltd., Wuxi (CN)

(72) Inventor: Luca Guazzerotti, Grosseto (IT)

(73) Assignee: Jiangyin Dafeima Automobile Technology Co., Ltd., Jiangyin (CN)

( * ) Notice: Subject to any disclaimer, the term of this patent is extended or adjusted under 35 U.S.C. 154(b) by 0 days.

(21) Appl. No.: 17/280,892

(22) PCT Filed: Dec. 31, 2020

(86) PCT No.: PCT/CN2020/142014

§ 371 (c)(1),
(2) Date: Mar. 28, 2021

(87) PCT Pub. No.: WO2022/121052

PCT Pub. Date: Jun. 16, 2022

(65) Prior Publication Data

US 2023/0292875 A1 Sep. 21, 2023

(30) Foreign Application Priority Data

Dec. 11, 2020 (CN) ..... 202011448628.X

(51) Int. Cl.
*A42B 3/22* (2006.01)
*A42B 3/32* (2006.01)

(52) U.S. Cl.
CPC ..... *A42B 3/222* (2013.01); *A42B 3/326* (2013.01)

(58) Field of Classification Search
CPC ..... A42B 3/222; A42B 3/223; A42B 3/205; A42B 3/225; A42B 3/226; A42B 3/326
See application file for complete search history.

(56) References Cited

U.S. PATENT DOCUMENTS

2008/0196148 A1 8/2008 Morin
2008/0216215 A1* 9/2008 Lee ..... A42B 3/326 2/10

(Continued)

FOREIGN PATENT DOCUMENTS

CN 107432520 A 12/2017
CN 105901820 B 1/2019

(Continued)

OTHER PUBLICATIONS

European Search Report, issued in European Application 21167168.0-1017, dated Oct. 19, 2021.
International Search Report, issued in PCT/CN2020/142014, dated Aug. 26, 2021.
Written Opinion, issued in PCT/CN2020/142014, dated Aug. 26, 2021.

*Primary Examiner* — Khoa D Huynh
*Assistant Examiner* — Erick I Lopez
(74) *Attorney, Agent, or Firm* — Zhu Lehnhoff LLP

(57) ABSTRACT

The invention discloses a helmet with associated rotation of a chin guard and a face mask, comprising a helmet body, wherein the face mask and the chin guard are symmetrically hinged to a mounting groove at a side surface of the helmet body, the mounting groove is provided with a face mask rotation limiter, a face mask mount, a linkage guide annular piece connected with the face mask mount, a driving rod matched with the annular groove on the linkage guide annular piece, a chin guard mount connected with the driving rod via hinging pieces, and a chin guard rotation guide clamped on the driving rod and the chin guard mount, wherein a double-track guide groove for guiding the rotation of the chin guard is formed in the chin guard rotation guide, and the hinging pieces provided at two ends of the driving rod respectively pass through the double-track guide groove and are connected with the chin guard mount; wherein the face mask rotation limiter is mounted on the mounting groove by a connector, and the linkage guide annular piece (Continued)

is hinged with the chin guard rotation guide by a first rotating shaft; and the chin rotation guide is connected with the mounting groove by a connector.

11 Claims, 14 Drawing Sheets

(56) References Cited

U.S. PATENT DOCUMENTS

| | | | | |
|---|---|---|---|---|
| 2009/0100576 | A1* | 4/2009 | Kim | A42B 3/222 2/9 |
| 2012/0284906 | A1 | 11/2012 | Kuo | |
| 2016/0015114 | A1 | 1/2016 | Berthier et al. | |
| 2020/0178639 | A1* | 6/2020 | Jwa | A42B 3/205 |

FOREIGN PATENT DOCUMENTS

| | | | |
|---|---|---|---|
| CN | 109875177 | A | 6/2019 |
| CN | 210329502 | U | 4/2020 |
| CN | 111264968 | A | 6/2020 |
| EP | 2478785 | A1 | 7/2012 |
| EP | 3001919 | A1 | 4/2016 |
| EP | 3662775 | A1 | 6/2020 |
| ES | 2625394 | T3 | 7/2017 |
| FR | 2876882 | A1 | 4/2006 |
| TW | I684418 | B | 2/2020 |

* cited by examiner

HELMET WITH ASSOCIATED ROTATION OF CHIN GUARD AND FACE MASK

TECHNICAL FIELD

The invention relates to the technical field of human body safety protection appliances, in particular to a helmet with a jaw protection structure, more particularly to a helmet with a chin guard which can rotate from a chin part of the helmet to a rear part of the helmet and can rotate in association with the helmet.

BACKGROUND ART

It is well known that users of various motor vehicles, racing cars, racing boats, balance cars, aircraft or even riding bicycles should wear helmets to protect their heads during the handling of the implements; in addition, in many special work situations, for example, personnel work in harsh environments such as spray shops, fire relief, anti-terrorist and anti-riot, mine exploration, coal mining, tunneling and the like, and they also need to wear the helmets to protect their heads from a variety of untimely injuries. At present, the structure types of the helmet mainly have a full-face structure type helmet and a half-face structure type helmet, wherein the full-face structure type helmet is provided with a jaw guard surrounding the chin of a user, and the half-face structure type helmet does not have the jaw guard. As for the full helmet structure type helmet, due to owning the jaw protection structure, it can play a better safety protection role on the head of a wearer; in the case of semi-helmet structure helmet, the wearer's mouth, nose and other organs are not restrained by the jaw guard, which shows better use amenity.

In the conventional full-face type helmet, the jaw guard and the helmet shell body are manufactured by integrating the both, namely the jaw guard belongs to a relatively fixed structural layout form relative to the helmet shell body. Undoubtedly, the conventional full-face helmet of this integrate construction is strong and firm, and therefore it provides a sufficient safety protection effect for the wearer. On the other hand, however, it is considered that the full-face helmet with the integral structure also has defects. Firstly, from the point of view of usage, when the wearer performs activities such as drinking water, talking, resting and so on, he must first remove the helmet to complete the corresponding actions. There is no doubt that the performance of the conventional integral structure type full-face helmet is relatively dull and inconvenient. Secondly, from the production point of view, due to the structural feature that a large inner cavity is provided with a small opening, the integral structure type full-face helmet is very complicated in mold, so that the production efficiency is not high, causing a high manufacturing cost of the integral structure type full-face helmet.

Clearly, the integral structure type full-face helmet do not meet multi-objective needs of safety, convenience, low cost, etc. In view of this, the development of a helmet which combines the advantages of safety of the full-face structure and convenience of the semi-helmet structure at the same time has naturally become the goal that helmet researchers and manufacturers strive to pursue.

Chinese patent application CN 105901820A proposes a variable jaw structure type helmet based on gear constraint, characterized in that a fixed inner gear of a cylindrical gear type is respectively arranged beside two sides of a helmet shell, two rotary outer gears of the cylindrical gear type are correspondingly, respectively and fixedly arranged on two forks of the jaw guard, a corresponding arc-shaped constraint groove is formed in a bottom support which is fixedly connected with the helmet shell, and the rotary outer gear and the fixed inner gear are limited by the constraint groove to be kept meshed and form a kinematic pair, so that the constraint required by a preset process is performed on the position and the posture of a jaw guard. Finally, the jaw guard can move and can be reversely converted according to a planned track between the positions of the full-face structure and the half-face structure. In other words, the jaw guard can be opened from the position of the full-face structure to the position of the half-face structure as required, and vice versa. Meanwhile, due to the fact that the jaw guard and the helmet shell body do not form an integral structure, the mold for manufacturing the helmet is simpler, the manufacturing cost can be reduced, and the production efficiency can be improved. It is clear that the gear constrained variable chin guard structure solution provided by the above-mentioned patent application is able to better address multi-objective needs of safety, convenience and low cost, thereby facilitating the advancement of helmet technology.

However, although the variable chin guard structure type helmet proposed by Chinese patent application CN 105901820A has self-evident advantages, a plurality of disadvantages are brought due to the fact that a long and arc-shaped constraint groove with a penetration characteristic is adopted to keep the meshing relationship between the rotary outer gears and the fixed inner gear and the rotary outer gear performs swinging motion with a large rotation angle along with the jaw guard. 1) The long and arc-shaped constraint groove presents a safety hazard to the helmet, because the helmet is in the form of a "quasi-half-face structure type helmet", which is advantageous for the wearer to perform activities such as drinking water, conversation and temporary breathing and especially suitable for tunnel work especially when a so-called uncovered helmet is formed when the jaw guard is in an intermediate position between the structures of the full-face helmet and the half-face helmet during the process of the jaw guard at a posture conversion. Due to the fact that the jaw guard cannot completely cover the constraint groove, that is, the body of the jaw guard cannot effectively cover the penetration-shaped long and arc-shaped constraint groove, an opportunity is created for foreign matters to enter a meshing kinematic pair formed by a rotary outer gear and a fixed inner gear; and once such a situation occurs, the gear constraint pair is extremely prone to blocking; in other words, the reliability of the helmet does have certain hidden danger in the using process. 2) The presence of a longer and arc-shaped constraint groove also makes the helmet noisy, and also a so-called uncovered helmet is formed when the jaw guard is in an intermediate position between the structures of the full-face helmet and the half-face helmet during the process of the jaw guard at a posture conversion; and it does not completely cover the constraint groove for the rider, whistling sound generated by the external air flow passing through the outer surface of the helmet can be easily transmitted into the interior of the helmet from the through-shaped constraint groove, and the constraint grooves are just arranged near the two ears of the wearer, so that the sound insulation effect of the helmet is poor or the comfort of the helmet is poor. 3) The safety of the helmet is weakened to a certain extent by the arrangement and the operation form of a planet-rotatory outer gear in which the planet-rotatory behavior is presented because the outer gear moves along with the jaw guard when the structure position of the jaw guard is changed; it is not difficult to find that the planet-rotatory outer gear sweeps a large space area; and obviously a fastening screw or other fastening structure cannot be arranged in the space area where the outer gear rotates through; at this time, the bottom support provided with the long arc-shaped constraint groove is forced to be arranged into a thin shell-shaped member with a larger span, and it is known that the inherent rigidity of the member in the structural form is relatively small, that is, the rigidity of the helmet shell is weak, and in other words, the safety of the helmet is weakened.

In addition, Chinese patent CN 210124365 U discloses a gear constraint type helmet with a variable jaw guard structure, which includes a helmet shell body, a jaw guard and a fork on the jaw guard; a bottom support, the fork, an inner gear, an outer gear and a transmission are adopted to form an associated mechanism, wherein the inner gear and the outer gear rotate as a fixed shaft and form a meshing constraint pair, and the inner gear and the fork are in sliding fit with each other and form a sliding constraint pair; and the transmission transmits the movement of the outer gear to the fork and promotes the guard jaw to generate telescopic displacement relative to the helmet shell body, so that the guard jaw performs rolling-over movement combined with reciprocating movement, and the posture conversion of the guard jaw is realized between the position of the full-face helmet and the position of the half-face helmet. Due to the fact that a through groove on the inner gear can be covered by the fork in the process of rolling the jaw guard, external foreign matters can be prevented from entering the gear pair to ensure the use reliability of the helmet, external noise can be blocked from entering the helmet to improve the use comfort of the helmet, less space occupied by the gear rotating by the fixed shaft creates conditions for improving the rigidity of related components, and the use safety of the helmet is also improved. However, the helmet is very complicated in structural construction, not convenient for processing and manufacturing, heavy in weight, high in manufacturing cost, short in service life and easy to be damaged.

Chinese patent CN 111264968A also discloses a chin guard positioning assembly and a helmet with the same, wherein a helmet body part covering the head of a user is connected with a chin guard which moves from a protection position to an open position or from the open position to the protection position, and the chin guard positioning assembly includes: a movable base part which is connected with the chin guard and can move with the chin guard together; a fixed base part which is connected with the helmet body part and the movable base part and becomes a reference for position movement of the movable base part; a fixed magnetic part fixed to the fixed base part; and a movable magnetic part which magnetically interacts with the fixed magnetic part and is fixed on the movable base part, so that the movable base part is fixed at a first position or a second position. The helmet also has the problems of complex structure, inconvenience in processing and manufacturing, inconvenience in use, heavy weight, high manufacturing cost, short service life, easy damage and the like.

In view of the above, there remains room for further improvement and promotion of the existing variable jaw guard structure type helmet.

SUMMARY OF THE INVENTION

The invention aims to overcome the defects in the prior art, and provides a helmet with associated rotation of chin guard and face mask which is simple in structure, small in number of parts, simple for processing and manufacturing, convenient to use, long in service life and light in overall weight.

In order to achieve the above object, the technical solution of the invention provides a helmet with associated rotation of a chin guard and a face mask, comprising a helmet body, wherein the face mask and the chin guard are symmetrically hinged at a side surface of the helmet body by a connecting assembly respectively, mounting grooves of the connecting assembly are symmetrically arranged on two sides of the helmet body, and the mounting grooves are respectively provided with a face mask rotation limiting piece in the connecting assembly, a face mask mount, a linkage guide annular piece connected with the face mask mount, a driving rod matched with the annular groove on the linkage guide annular piece, a chin guard mount connected with the driving rod via hinging pieces, and a chin guard rotation guide clamped on the driving rod and the chin guard mount, wherein a double-track guide groove for guiding the rotation of the chin guard is formed in the chin guard rotation guide, the hinging pieces provided at two ends of the driving rod respectively pass through the double-track guide groove and are connected with the chin guard mount; wherein the face mask rotation limiting piece is mounted on the mounting groove by a connector, and the linkage guide annular piece is hinged with the chin guard rotation guide by a first rotating shaft; and the chin rotation guide is connected with the mounting groove by a connector, a face mask rotation limiting guide groove is provided on the face mask rotation limiting piece, and a limiting guide piece matched with the limiting guide groove is further provided on the linkage guide annular piece.

In order to conveniently hide the connecting assembly inside the helmet body without being damaged and achieve the effect of beautiful appearance, the preferred technical solution includes that the mounting grooves are grooves which are symmetrically arranged on two sides of the helmet body and are respectively concave inwards; the grooves have a stepped groove structure and are divided into three layers including a face mask rotation limiter mounting groove located in a third layer, a chin rotation guide mounting groove located in a first layer, and a groove for defining motion range of a driving end of the driving rod located in a second layer respectively; and the shape of the face mask rotation limiter mounting groove is matched with that of the face mask rotation limiter, the shape of the chin rotation guide mounting groove is matched with that of the chin rotation guide, and the shape of the groove for defining motion range of the driving end of the driving rod is matched with the motion range of the driving end of the driving rod.

In order to effectively limit the rotation range of the face mask and simultaneously prevent the face mask from automatically sliding down after rotating to a predetermined position, or prevent the face mask from swinging up and down due to vibration and jounce of the helmet body when the helmet is worn, the preferred technical solution also includes that the face mask rotation limiter is an arc-shaped strip piece, an inner arc-shaped surface of the arc-shaped strip piece is an arc-shaped surface, an outer arc-shaped surface of the arc-shaped strip piece is an arc-shaped surface provided with a limiting guide groove, and a plurality of segments of arc-shaped grooves with different curvature radii are arranged on the arc-shaped surface provided with the limiting guide groove to form a tooth-shaped arc-shaped limiting guide groove; and the face mask rotation limiter has a shell structure, connectors are pre-embedded in two ends of the arc-shaped strip piece at one side of a cavity of the shell, and the arc-shaped strip piece enables one side of the cavity of the shell to face towards the mounting groove of the face mask rotation limiter on the helmet body. The face mask rotation limiter is manufactured into a shell structure, so that the weight of the face mask rotation limiter is reduced conveniently, and raw materials can be saved. A plurality of segments of arc-shaped grooves with different curvature radii are arranged on the arc-shaped surface provided with the limiting guide groove to form a tooth-shaped arc-shaped limiting guide groove structure, which is mainly used for facilitating that the face mask cannot automatically slide down when the face mask stays at any position in the rotating process.

In order to facilitate the connection between the face mask and the linkage guide annular piece together and simplify the construction of mounting operation, a preferred technical solution includes that the face mask mount has a strip-shaped arc-shaped surface structure, the side of an outer arc-shaped surface of the strip-shaped arc-shaped surface is used for being connected with the face mask, the side of an inner arc-shaped surface of the strip-shaped arc-shaped surface is used for being connected with a linkage guide annular piece, or the side of an inner arc-shaped surface of the strip-shaped arc-shaped surface and the linkage guide annular piece form an integral structure; and the strip-shaped arc-shaped surface is provided with a slot and/or a convex edge on the side of the outer arc-shaped surface used for being connected with the face mask, and the width of the strip-shaped arc-shaped surface is greater than that of the linkage guide annular piece.

In order to reduce the structural size of the linkage guide annular piece as much as possible, reduce the weight of the linkage guide annular piece, facilitate the connection between the linkage guide annular piece and the helmet body, and facilitate the face mask rotating around the rotation center and staying at a predetermined position without sliding down, a further preferred technical solution includes that the linkage guide annular piece has a D-shaped annular structure, the side of a straight edge of the linkage guide annular piece with the D-shaped annular structure corresponds to the side of an inner arc-shaped surface of the strip-shaped arc-shaped surface, and a connecting part is arranged between the side of the straight edge of the linkage guide annular piece and the side of the inner arc-shaped surface of the strip-shaped arc-shaped surface; and a first through hole is formed in one side of the annular edge of the D-shaped linkage guide annular piece, the first rotating shaft hinged with the chin rotation guide is arranged in the first through hole, and the linkage guide annular piece swings around the first rotating shaft under the driving of the driving end of the driving rod.

In order to reduce the structural size of the linkage guide annular piece as much as possible, reduce the weight of the linkage guide annular piece, facilitate the connection between the linkage guide annular piece and the helmet body, facilitate the face mask rotating around the rotation center and staying at a predetermined position without sliding down, a further preferred technical solution also includes that a second through hole is further formed in the side of the straight edge of the D-shaped linkage guide annular piece, a second rotating shaft is arranged in the second through hole, one end of the second rotating shaft is in sliding fit with one side of the second through hole, and the other end of the second rotating shaft extends out of one side of the D-shaped linkage guide annular piece; and the other end of the second rotating shaft is provided with a guide roller matched with the tooth-shaped arc-shaped limiting guide groove, the second through hole is a hourglass-shaped long hole formed along a radial direction of the strip-shaped arc-shaped surface of the face mask mount, a spring used for pressing the second rotating shaft is arranged in the hourglass-shaped long hole, and the spring is used for enabling the guide roller to be always press-fitted with the tooth-shaped arc-shaped limiting guide groove.

In order to conveniently drive the driving rod together by the chin guard and the chin guard connector and drive the linkage guide annular piece to rotate around the rotation center to rotate the face mask, a preferred technical solution includes that the driving rod has an elongated rod-shaped structure and is arranged between the linkage guide annular piece and the chin guard rotation guide, the driving end of the driving rod for being matched with an inner ring of the linkage guide annular piece is arranged at one end of the elongated rod-shaped driving rod, and the other end of the driving rod is located outside the linkage guide annular piece; and two ends of the driving rod are respectively provided with a shaft hole that passes through the driving rod, the first driving shaft and the second driving shaft are respectively arranged in the two shaft holes, the first driving shaft passes through the shaft hole at the driving end of the driving rod, and the second driving shaft passes through the shaft hole at the other end of the driving rod.

In order to guide and define the motion trajectory of the driving rod conveniently, for the linkage guide annular piece and the driving rod installed in the installation groove conveniently, and meanwhile, in order to minimize the structural size and weight of the chin guard rotation guide, a further preferred technical solution includes that the chin guard rotation guide has a structure of a D-shaped shell, a through double-track guide groove is formed in the D-shaped shell, and a first guide groove in the through double-track guide groove is in sliding fit with a first driving shaft passing through the shaft hole at the driving end of the driving rod, and a second guide groove in the through double-track guide groove is in sliding fit with a second driving shaft in the shaft hole at the other end of the driving rod; the first guide groove and the second guide groove are arc-shaped grooves which are arranged in a front-back and inclined manner, the length of the second guide groove is twice or more than that of the first guide groove, and a side sliding groove which is in sliding fit with the driving rod is arranged on an edge of the side of a straight edge segment of the D-shaped shell; and the D-shaped shell is also provided with a mounting hole of the chin guard rotation guide and a mounting hole at one end of the first rotating shaft.

In order to facilitate the connection between the chin guard and the chin guard mount, and meanwhile to enable the connection between the chin guard mount and the driving rod, and in order to minimize the structural size of the chin guard mount and reduce the weight of the chin guard mount, a further preferred technical solution also includes that the chin guard mount is a T-shaped structural member and arranged on the outer side of the chin guard rotation guide; rotating shaft mounting holes of the first driving shaft and the second driving shaft are formed in a vertical segment of the T-shaped structural member, and a fixed mounting hole of the chin guard is formed in a transverse segment of the T-shaped structural member; and the ends of the first driving shaft and the second driving shaft pass through the rotating shaft mounting holes and are connected with the chin guard mount via a connector or a clamping piece, and the chin guard is connected with the chin guard mount through the fixed mounting hole via a fastening piece or the clamping piece.

In order to reduce the overall weight of the helmet, facilitate the batch production of various parts on the helmet, improve the processing and manufacturing efficiency of the helmet and reduce the manufacturing cost by technicians of the helmet, a further preferred technical solution also includes that the helmet body, the face mask, the chin guard, the face mask rotation limiter, the face mask mount, the linkage guide annular piece, the driving rod, the chin guard rotation guide and the chin guard mount are injection-molded or compression-molded from a high polymer material.

The advantages and beneficial effects of the invention lie in that helmet with associated rotation of a chin guard and a face mask is simple in structure, small in number of parts, simple for processing and manufacturing, convenient to use, long in service life, light in overall weight and the like.

Compared with the helmet with the same or similar using effect which has been disclosed in the prior art, the helmet with associated rotation of a chin guard and a face mask has the advantages that the structure of the all kinds of connecting parts and driving wheel components for the rotation of the chin guard and the face mask is greatly simplified, and has the number of ⅓-⅕ of the parts for mounting and driving the chin guard and the face mask; meanwhile, the complexity of each part is greatly simplified, so that the helmet product has greatly improved its use performance. Due to the fact that the number of the parts is small and the structure of each part is simple, the processing and manufacturing cost of the helmet is lower, the use reliability is improved, the service life is prolonged, the helmet is more convenient to assemble and disassemble, and the opening/closing operation of the chin guard and the face mask in the use process is more convenient, quicker and better in stability.

Figure 1:
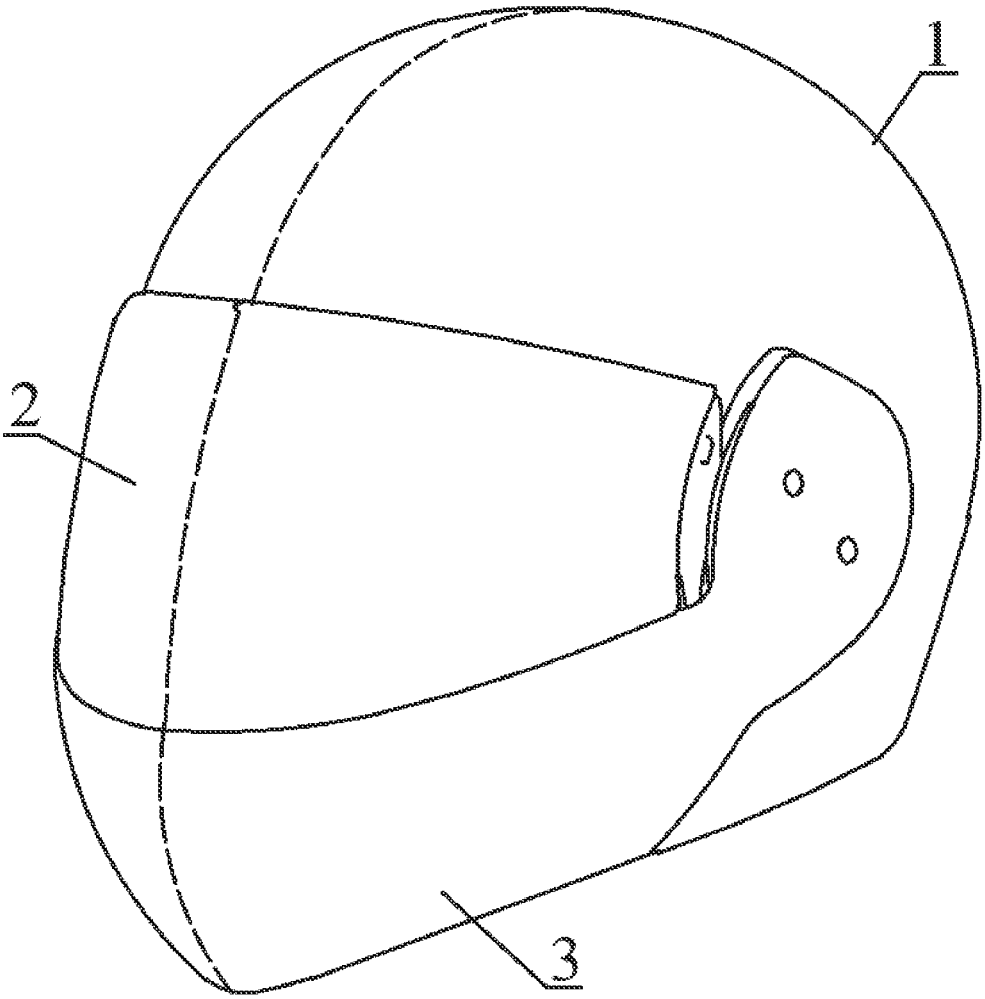
FIG. 1 is a structural view from a bird's eye view of a helmet with associated rotation of a chin guard and a face mask according to the invention.

In the drawings: 1, helmet body; 2, face mask; 3, chin guard; 4, mounting groove; 4.1, first layer; 4.2, second layer; 4.3, third layer; 5, face mask rotation limiter; 5.1, face mask rotation limiting guide groove; 6, face mask mount; 6.1, slot; 6.2, convex edge; 7, linkage guide annular piece; 7.1, annular groove; 7.2, straight edge; 7.3, connecting part; 7.4, annular rim; 7.5, first through hole; 7.6, second through hole; 7.7, D-shaped arc-shaped surface; 8, driving rod; 8.1, driving end; 9, chin guard rotation guide; 9.1, first guide groove; 9.2, second guide groove; 9.3, side sliding groove; 9.4, mounting hole; 10, chin guard mount; 10.1, vertical segment; 10.2, rotating shaft mounting hole; 10.3, transverse segment; 10.4, mounting hole; 11, first rotating shaft; 12, rotation center; 13, second rotating shaft; 14, guide roller; 15, shaft hole; 16, first driving shaft; 17, second driving shaft.

DETAILED DESCRIPTION OF THE INVENTION

Reference will now be made in detail to the implementations of the present invention in combination with the accompanying drawings and embodiments below. The following embodiments are only intended to more clearly illustrate the technical solution of the present invention, and are not intended to limit the scope of the present invention.

As shown in FIGS. 1-15, the invention provides a helmet with associated rotation of a chin guard and a face mask, comprising a helmet body 1, wherein a face mask 2 and a chin guard 3 are symmetrically hinged at a side surface of the helmet body 1 by a connecting assembly respectively, mounting grooves 4 of the connecting assembly are symmetrically arranged on two sides of the helmet body 1, and the mounting grooves 4 are respectively provided with a face mask rotation limiter 5 in the connecting assembly, a face mask mount 6, a linkage guide annular piece 7 connected with the face mask mount 6, a driving rod 8 matched with the annular groove 7.1 on the linkage guide annular piece 7, a chin guard mount 10 connected with the driving rod 8 via hinging pieces, and a chin guard rotation guide 9 clamped on the driving rod 8 and the chin guard mount 10, wherein a double-track guide groove for guiding the rotation of the chin guard is formed in the chin guard rotation guide 9, the hinging pieces provided at two ends of the driving rod 8 respectively pass through the double-track guide groove and are connected with the chin guard mount 10; wherein the face mask rotation limiter 5 is mounted on the mounting groove 4 by a bolt connector, and the linkage guide annular piece 7 is hinged with the chin guard rotation guide 9 by a first rotating shaft 11; and the chin rotation guide 9 is connected with the mounting groove 4 by the bolt connector, a face mask rotation limiting guide groove 5.1 is provided on the face mask rotation limiter 5, and a limiting guide piece matched with the face mask rotation limiting guide groove 5.1 is further provided on the linkage guide annular piece 9.

In order to conveniently hide the connecting assembly inside the helmet body 1 without being damaged and achieve the effect of beautiful appearance, a preferred embodiment of the invention includes that the mounting grooves 4 are grooves which are symmetrically arranged on two sides of the helmet body 1 and are respectively concave inwards; the grooves have a stepped groove structure and are divided into three layers including a face mask rotation limiter 4 mounting groove located in a third layer 4.3, a chin rotation guide 9 mounting groove located in a first layer 4.1, and a groove for defining motion range of a driving end 8.1 of the driving rod 8 located in a second layer 4.2 respectively; and the shape of the face mask rotation limiter 5 mounting groove is matched with that of the face mask rotation limiter 5, the shape of the chin rotation guide 9 mounting groove is matched with that of the chin rotation guide 9, and the shape of the groove for defining motion range of the driving end 8.1 of the driving rod 8 is matched with the motion range of the driving end 8.1 of the driving rod 8.

In order to effectively limit the rotation range of the face mask 2 and simultaneously prevent the face mask 2 from automatically sliding down after rotating to a predetermined position, or prevent that the face mask 2 from swinging up and down due to vibration and jounce of the helmet body 1 when the helmet is worn, a preferred embodiment of the invention further includes that the face mask rotation limiter 5 is an arc-shaped strip piece, an inner arc-shaped surface 5.2 of the arc-shaped strip piece is an arc-shaped surface, an outer arc-shaped surface 5.3 of the arc-shaped strip piece is an arc-shaped surface provided with a limiting guide groove 5.1, and a plurality of segments of arc-shaped grooves with different curvature radii are arranged on the arc-shaped surface provided with the limiting guide groove 5.1 to form a tooth-shaped arc-shaped limiting guide groove 5.1; and the face mask rotation limiter 5 has a shell structure, connectors are pre-embedded in two ends of the arc-shaped strip piece at one side of a cavity of the shell, and the arc-shaped strip piece enables one side of the cavity of the shell to face towards the mounting groove of the face mask rotation limiter 5 on the helmet body 1. The face mask rotation limiter 5 is manufactured into a shell structure, so that the weight of the face mask rotation limiter 5 is reduced conveniently, and raw materials can be saved. A plurality of segments of arc-shaped grooves with different curvature radii are arranged on the arc-shaped surface provided with the limiting guide groove 5.1 to form a tooth-shaped arc-shaped limiting guide groove structure, which is mainly used for facilitating that the face mask 2 cannot automatically slide down when the face mask 2 stays at any position in the rotating process.

In order to facilitate the connection between the face mask 2 and the linkage guide annular piece 7 together and simplify the construction of mounting operation, a preferred embodiment of the invention includes that the face mask mount 6 has a strip-shaped arc-shaped surface structure, the side of an outer arc-shaped surface of the strip-shaped arc-shaped surface is used for being connected with the face mask 2, the side of an inner arc-shaped surface of the strip-shaped arc-shaped surface is used for being connected with a linkage guide annular piece 7, or the side of an inner arc-shaped surface of the strip-shaped arc-shaped surface and the linkage guide annular piece 7 form an integral structure; and the strip-shaped arc-shaped surface is provided with a slot 6.1 and/or a convex edge 6.2 on the side of the outer arc-shaped surface used for being connected with the face mask 2, and the width of the strip-shaped arc-shaped surface is greater than that of the linkage guide annular piece 7.

In order to reduce the structural size of the linkage guide annular piece 7 as much as possible, reduce the weight of the linkage guide annular piece 7, facilitate the connection between the linkage guide annular piece 7 and the helmet body 1, and facilitate the face mask 2 rotating around the rotation center 12 and staying at a predetermined position without sliding down, a further preferred embodiment of the invention includes that the linkage guide annular piece 7 has a D-shaped annular structure, the side of the straight edge 7.2 of the linkage guide annular piece 7 with the D-shaped annular structure corresponds to the side of the inner arc-shaped surface of the strip-shaped arc-shaped surface of the face mask mount 6, a connecting part 7.3 is arranged between the side of the straight edge 7.2 of the linkage guide annular piece 7 with the D-shaped annular structure and the side of the inner arc-shaped surface of the strip-shaped arc-shaped surface; and a first through hole 7.5 is formed in the side of the annular edge 7.4 of the D-shaped linkage guide annular piece 7, the first rotating shaft 11 hinged with the chin rotation guide 9 is arranged in the first through hole 7, and the linkage guide annular piece 7 swings around the first rotating shaft 11 under the driving of the driving end 8.1 of the driving rod 8.

In order to reduce the structural size of the linkage guide annular piece 7 as much as possible, reduce the weight of the linkage guide annular piece 7, facilitate the connection between the linkage guide annular piece 7 and the helmet body 1, facilitate the face mask rotating around the rotation center 12 and staying at a predetermined position without sliding down, a further preferred embodiment of the invention also includes that a second through hole 7.6 is further formed in the side of the straight edge 7.2 of the D-shaped linkage guide annular piece 7, a second rotating shaft 13 is arranged in the second through hole 7.6, one end of the second rotating shaft 13 is in sliding fit with one side of the second through hole 7.6, and the other end of the second rotating shaft 13 extends out of one side of the D-shaped linkage guide annular piece 7; and the other end of the second rotating shaft 13 is provided with a guide roller 14 matched with the tooth-shaped arc-shaped limiting guide groove, the second through hole 7.6 is a hourglass-shaped long hole formed along a radial direction of the strip-shaped arc-shaped surface of the face mask mount, a spring (not shown) used for pressing the second rotating shaft 13 is arranged in the hourglass-shaped long hole, and the spring is used for enabling the guide roller 14 to be always press-fitted with the tooth-shaped arc-shaped limiting guide groove.

In order to conveniently drive the driving rod 8 together by the chin guard 3 and the chin guard connector 10 and drive the linkage guide annular piece 7 to rotate around the rotation center 12 to rotate the face mask 2, a preferred embodiment of the invention also includes that the driving rod 8 has an elongated rod-shaped structure and is arranged between the linkage guide annular piece 7 and the chin guard rotation guide 9, the driving end 8.1 of the driving rod 8 for being matched with an inner ring of the linkage guide annular piece 7 is arranged at one end of the elongated rod-shaped driving rod 8, and the other end of the driving rod 8 is located outside the linkage guide annular piece 7; and two ends of the driving rod 8 are respectively provided with a shaft hole 15 for the driving rod to pass through, the first driving shaft 16 and the second driving shaft 17 are respectively arranged in the two shaft holes 15, the first driving shaft 16 passes through the shaft hole 15 at the driving end 8.1 of the driving rod 8, and the second driving shaft 17 passes through the shaft hole 15 at the other end of the driving rod 8.

In order to guide and define the motion trajectory of the driving rod 8 conveniently, for the linkage guide annular piece 7 and the driving rod 8 installed in the installation groove 4 conveniently, and meanwhile, in order to minimize the structural size and weight of the chin guard rotation guide 9, a further preferred embodiment also includes that the chin guard rotation guide 9 has a structure of a D-shaped shell, a through double-track guide groove is formed in the D-shaped shell, and a first guide groove 9.1 in the through double-track guide groove is in sliding fit with a first driving shaft 16 passing through the shaft hole 15 at the driving end 8.1 of the driving rod 8, and a second guide groove 9.2 in the through double-track guide groove is in sliding fit with a second driving shaft 17 passing through the shaft hole 15 at the other end of the driving rod 8; the first guide groove 9.1 and the second guide groove 9.2 are arc-shaped grooves which are arranged in a front-back and inclined manner, the length of the second guide groove 9.2 is twice or more than that of the first guide groove, and a side sliding groove 9.3 which is in sliding fit with the driving rod 8 is arranged on an edge of the side of a straight edge 7.2 segment of the D-shaped shell; and the D-shaped shell is also provided with a mounting hole 9.4 of the chin guard rotation guide 9 and a mounting hole at one end of the first rotating shaft 11.

In order to facilitate the connection between the chin guard 3 and the chin guard mount 10, and meanwhile to enable the connection between the chin guard mount 10 and the driving rod 8, and in order to minimize the structural size of the chin guard mount 10 and reduce the weight of the chin guard mount 10, a further preferred embodiment of the invention also includes that the chin guard mount 10 is a T-shaped structural member and arranged on the outer side of the chin guard rotation guide 9; rotating shaft mounting holes 10.2 of the first driving shaft 16 and the second driving shaft 17 are formed in a vertical segment of the T-shaped structural member 10.1, and a fixed mounting hole 10.4 of the chin guard is formed in a transverse segment 10.3 of the T-shaped structural member; and the ends of the first driving shaft 16 and the second driving shaft 17 pass through the rotating shaft mounting holes 10.2 and are connected with the chin guard mount 10 via a connector or a clamping piece, and the chin guard 3 is connected with the chin guard mount 10 through the fixed mounting hole 10.4 via a fastening piece or the clamping piece.

In order to reduce the overall weight of the helmet, facilitate the batch production of various parts on the helmet, improve the processing and manufacturing efficiency of the helmet and reduce the manufacturing cost by technicians of the helmet, a further preferred embodiment of the invention also includes that the helmet body 1, the face mask 2, the chin guard 3, the face mask rotation limiter 5, the face mask mount 6, the linkage guide annular piece 7, the driving rod 8, the chin guard rotation guide 9 and the chin guard mount 10 are injection-molded or compression-molded from a high polymer material.

The working principle of the helmet with associated rotation of a chin guard and a face mask is as follows.

The associated rotation in the helmet with associated rotation of a chin guard and a face mask means that, as shown in FIGS. 4-14, the chin guard 3 also drives the face mask 2 to be raised upwardly and rotate together during the process that the chin guard 3 is raised upwardly and rotated. During the process that the face mask 2 is raised upwardly and rotated together by the chin guard 3, when the lower edge of the face mask 2 slightly exceeds the edge of a front part of the helmet body 1, the face mask 2 stops rotating upwardly, and the chin guard 3 can continue rotating upwardly and backwardly until the front part of the chin guard 3 rotates to a middle position behind the helmet body 1.

Thereafter the face mask 2 can be pulled back down alone, in which case only the face mask 2 can act as a face protector for the face, and the chin guard 3 is not placed in the chin position and the chin position cannot be protected. At the moment, the chin guard 3 can also be rotated from back to front and reset; during the process of rotating and resetting the chin guard 3, the face mask 2 which has been pulled down can be raised upwardly, and then the chin guard 3 drives the face mask 2 to reset from top to bottom to the initial state of the face mask 2 and the chin guard 3, that is, the face and the chin are protected by the face mask 2 and the chin guard 3.

Figure 5:
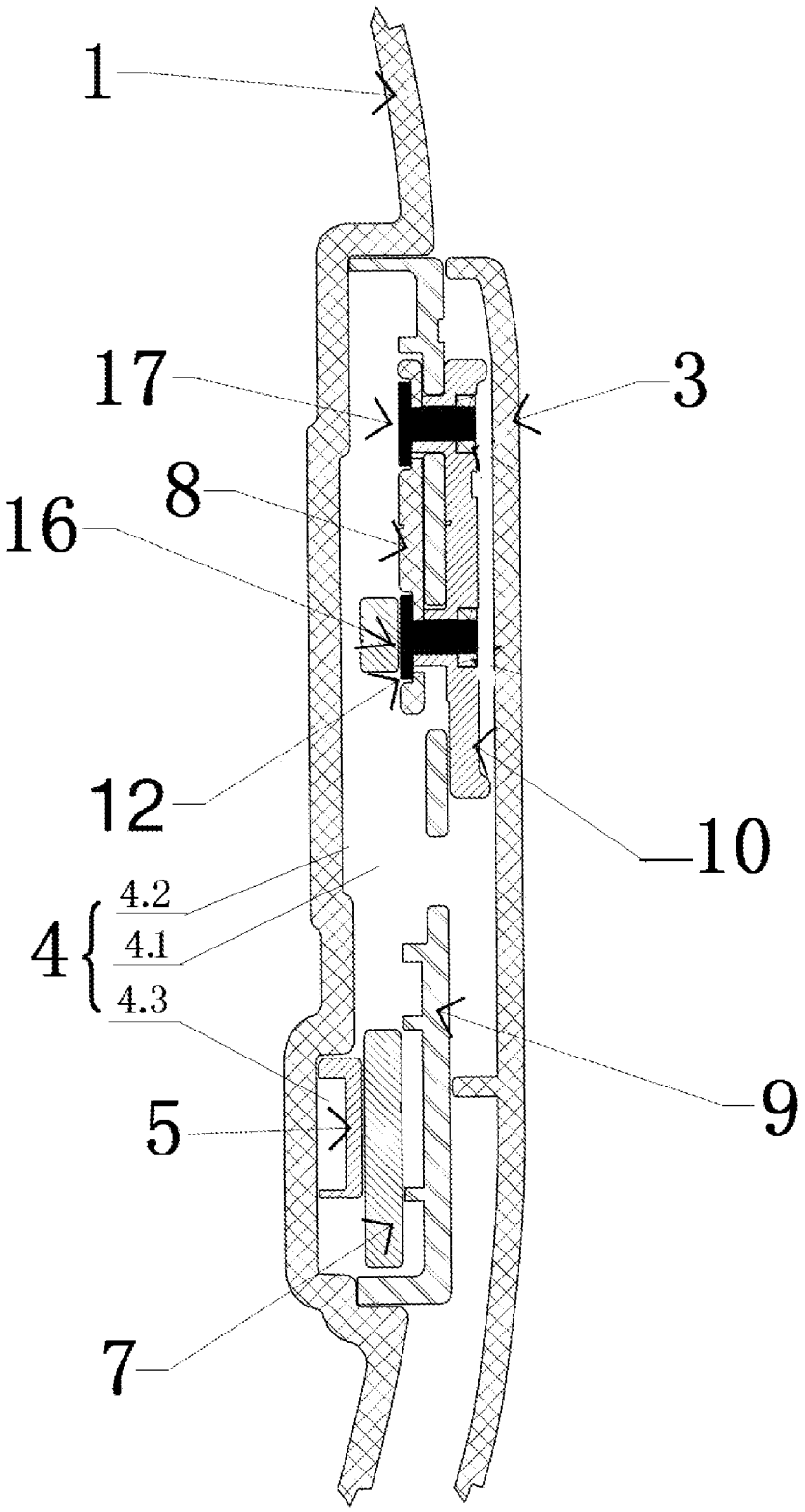
FIG. 5 is a cross-sectional structure view taken along AA-AA of FIG. 4.
Figure 6:
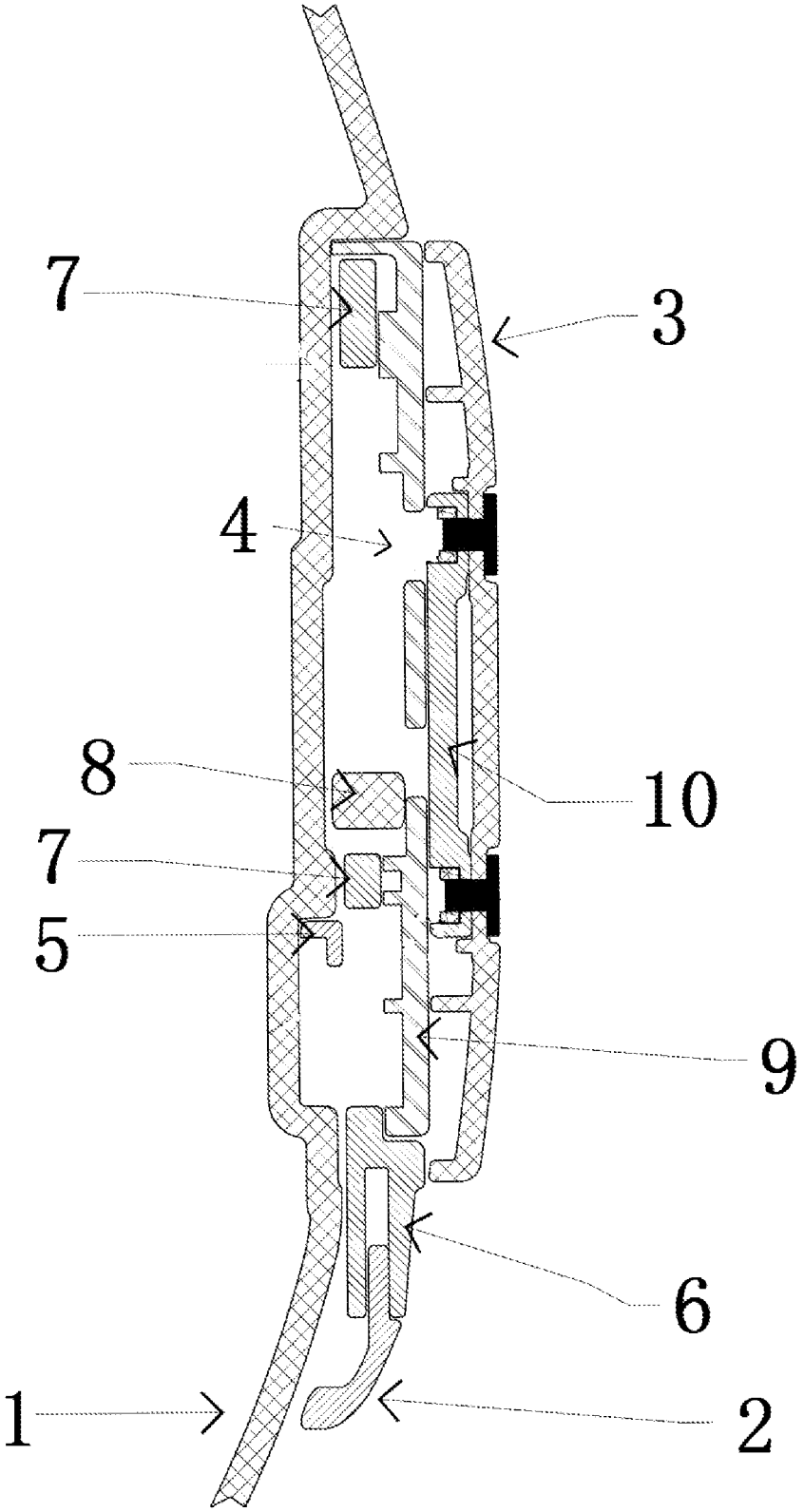
FIG. 6 is a cross-sectional structure view taken along BB-BB of FIG. 4.
Figure 7:
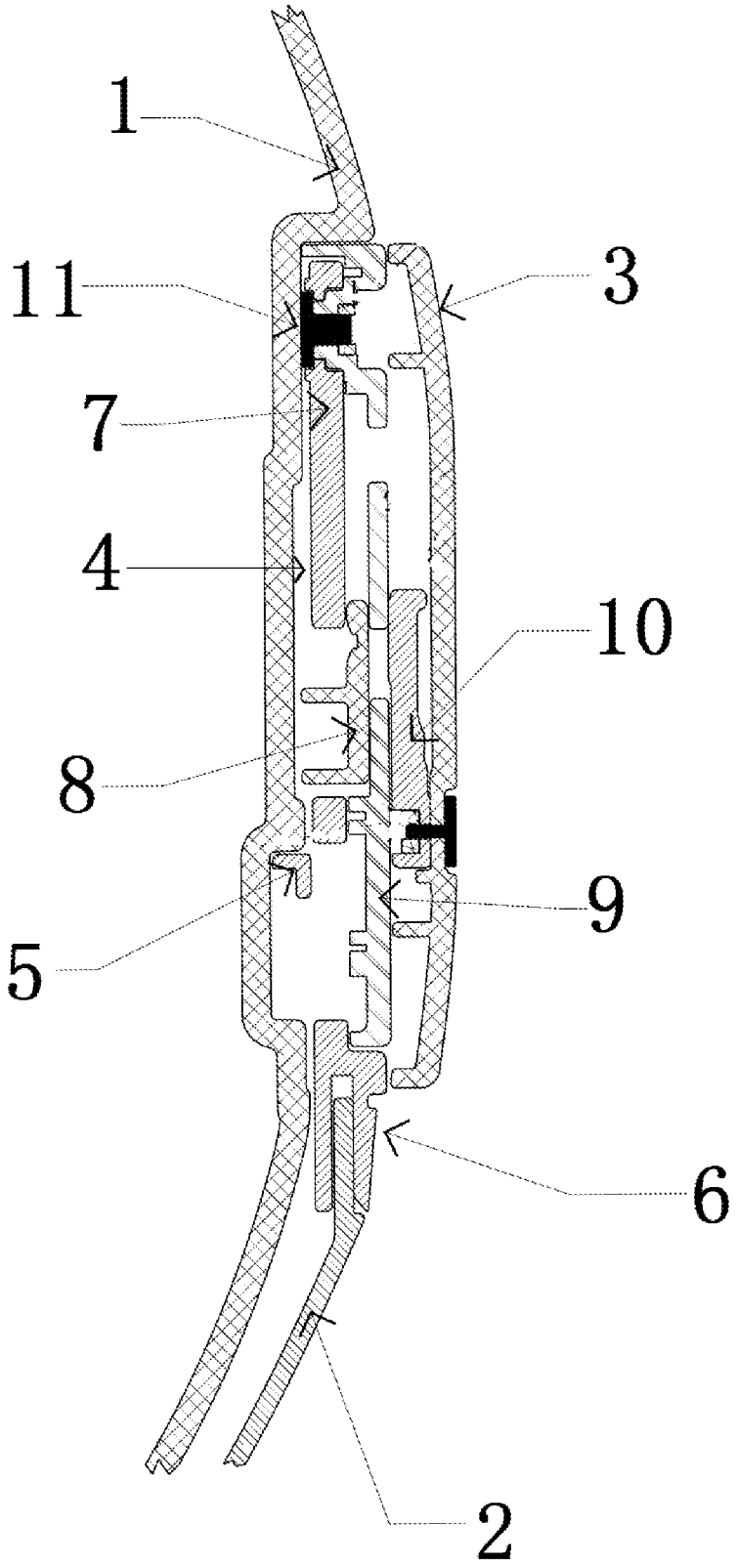
FIG. 7 is a cross-sectional structure view taken along CC-CC of FIG. 4.
Figure 8:
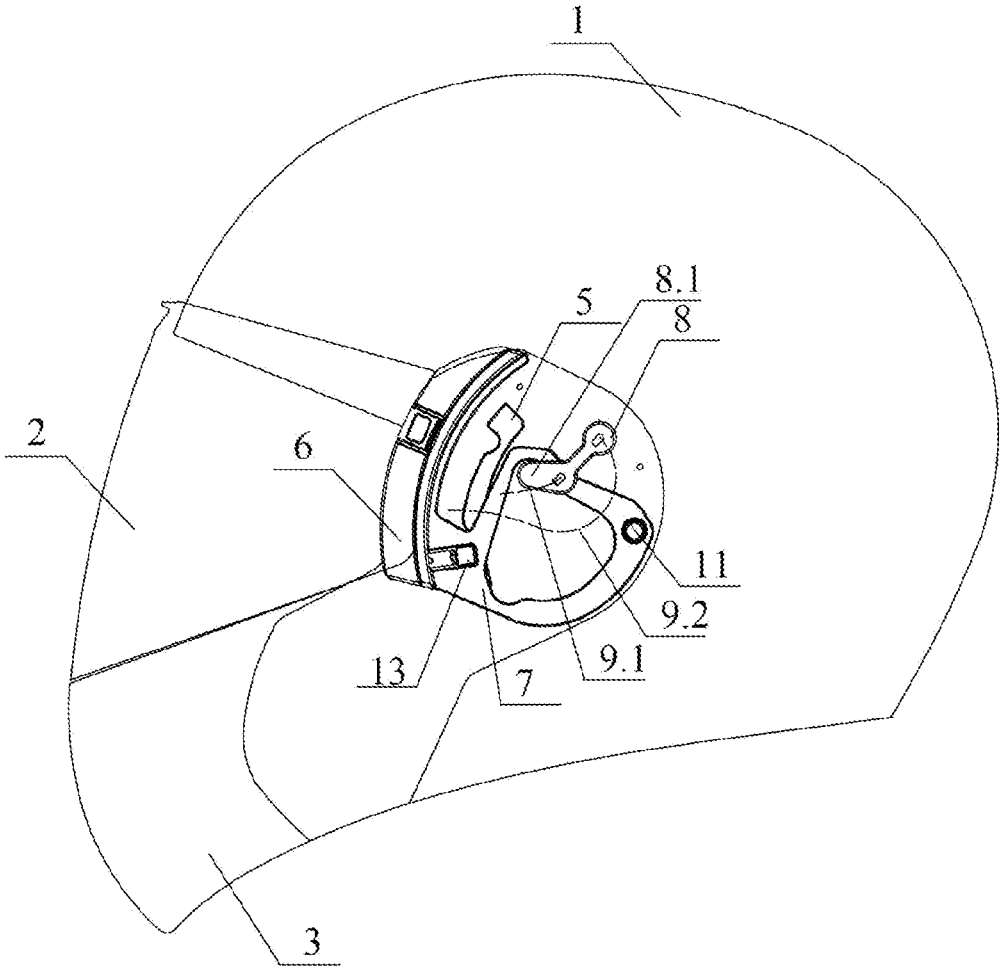
FIG. 8 is a structural side view of the helmet in an initial state after a chin guard rotation guide has been removed from FIG. 4.
Figure 9:
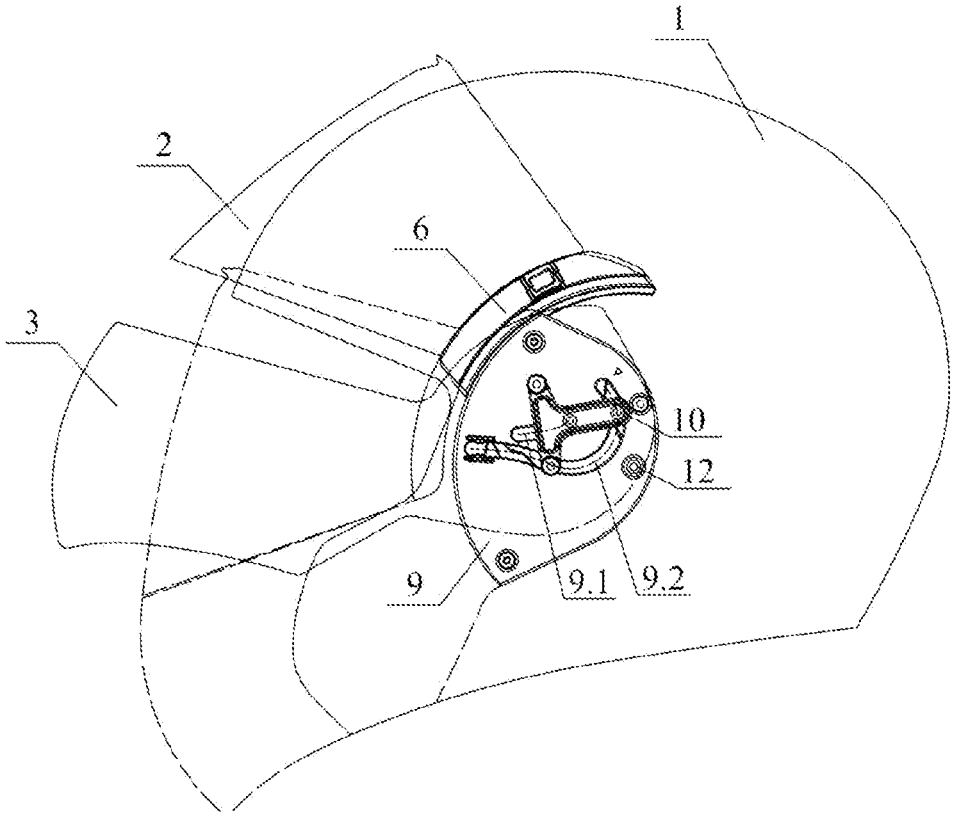
FIG. 9 is a structural side view of the helmet shown in FIG. 8 in a state of causing the face mask and the chin guard to be raised upwardly when the chin guard rotation guide is not removed.
Figure 10:
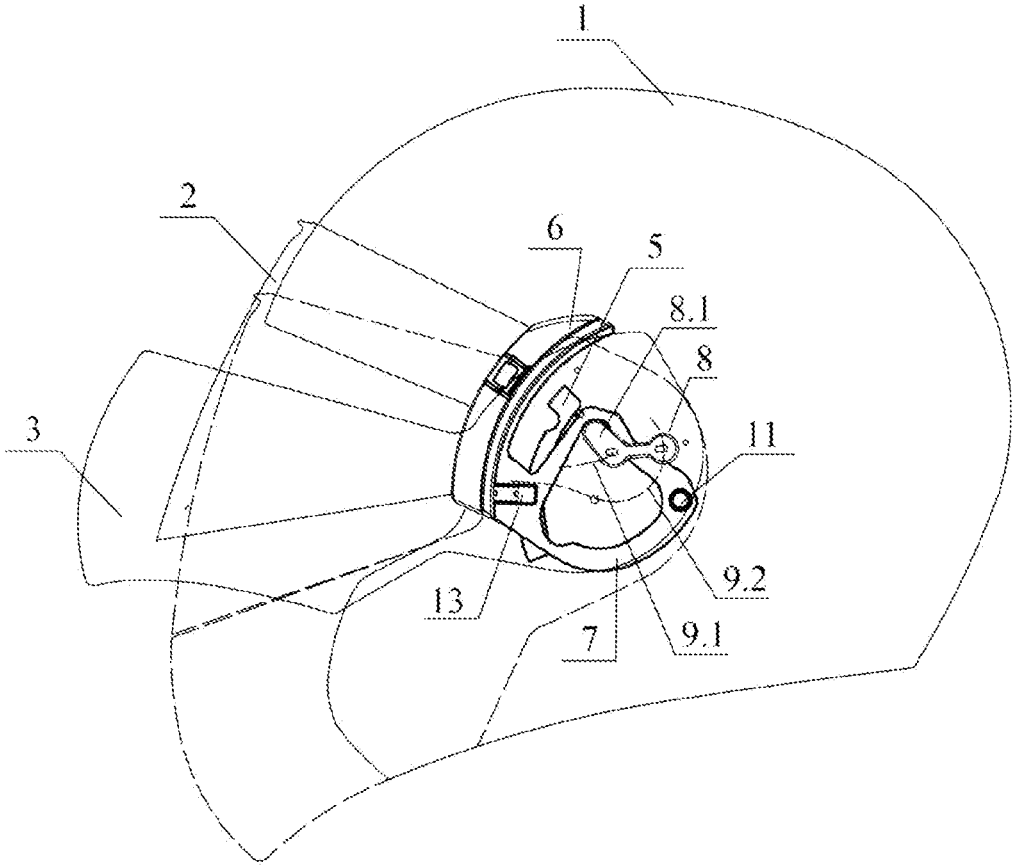
FIG. 10 is a structural side view of the helmet shown in FIG. 8 in a state of causing the face mask and the chin guard to be raised upwardly when the chin guard rotation guide is removed.
Figure 11:
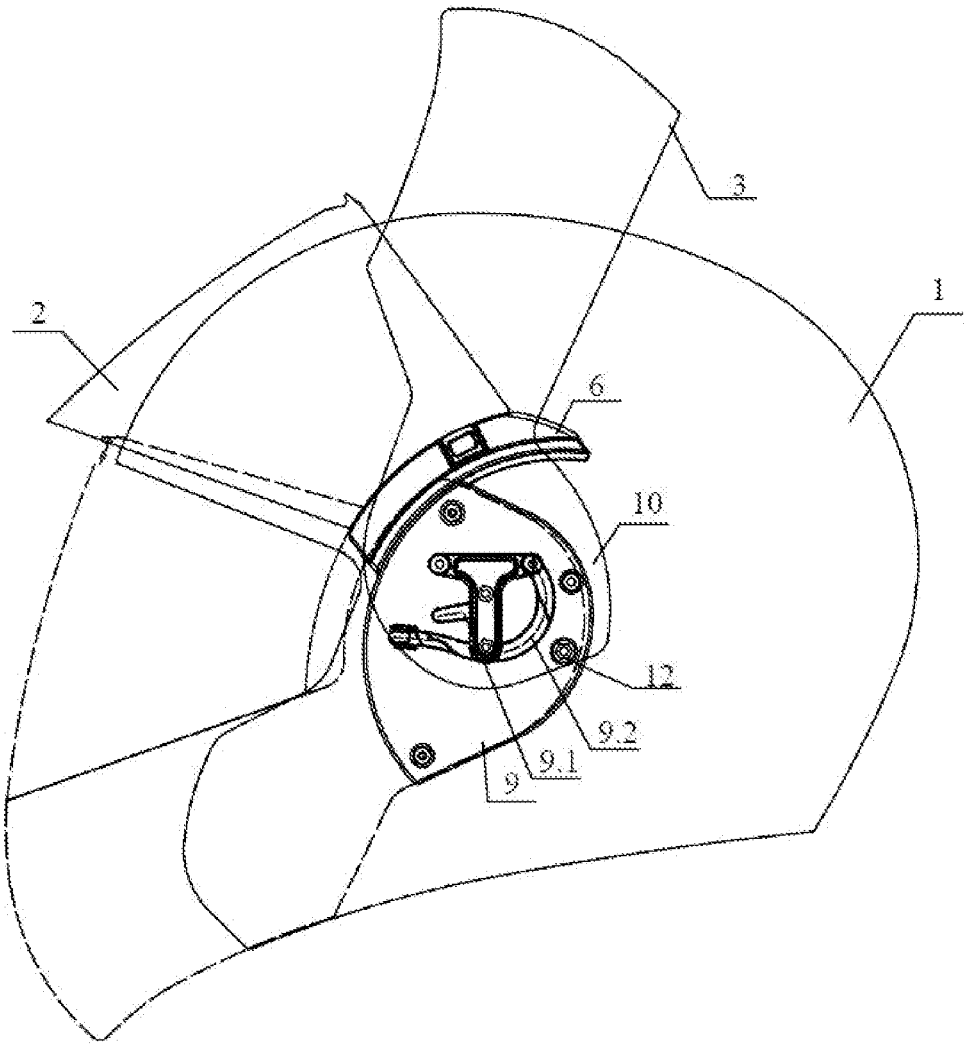
FIG. 11 is a structural side view of the helmet shown in FIG. 8 in a state of causing the face mask to be raised to a limiting condition and the chin guard to continue to be raised upwardly when the chin guard rotation guide is not removed.
Figure 12:
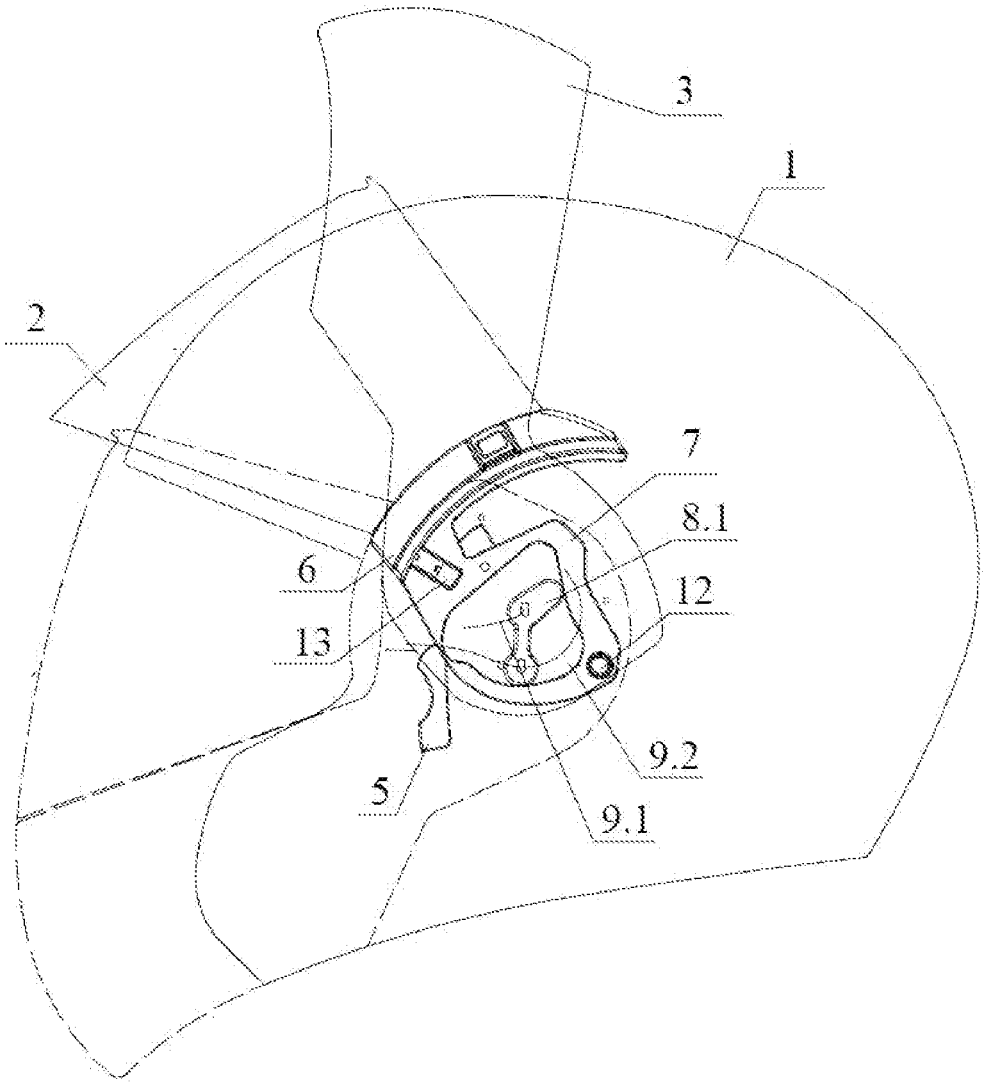
FIG. 12 is a structural side view of the helmet shown in FIG. 8 in a state of causing the face mask to be raised to a limiting condition and the chin guard to continue to be raised upwardly when the chin guard rotation guide is removed.
Figure 13:
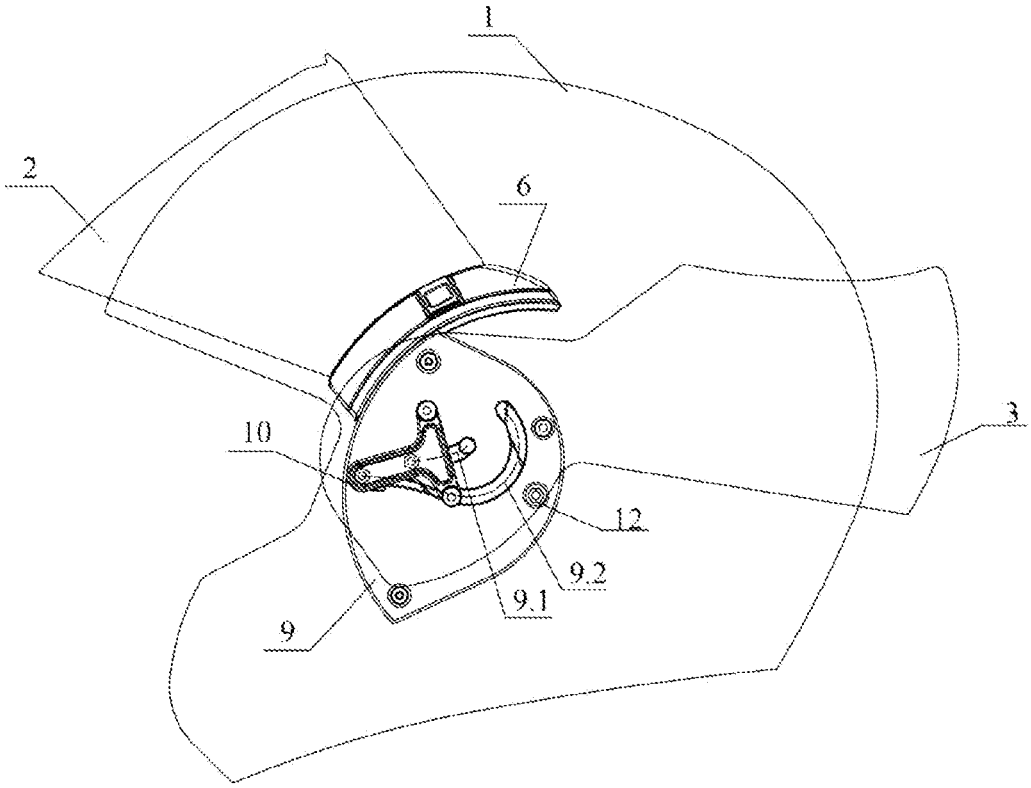
FIG. 13 is a structural side view of the helmet shown in FIG. 8 in a state of causing the face mask to be raised to a limiting condition and the chin guard to be raised upwardly to a limiting condition when the chin guard rotation guide is removed.
Figure 14:
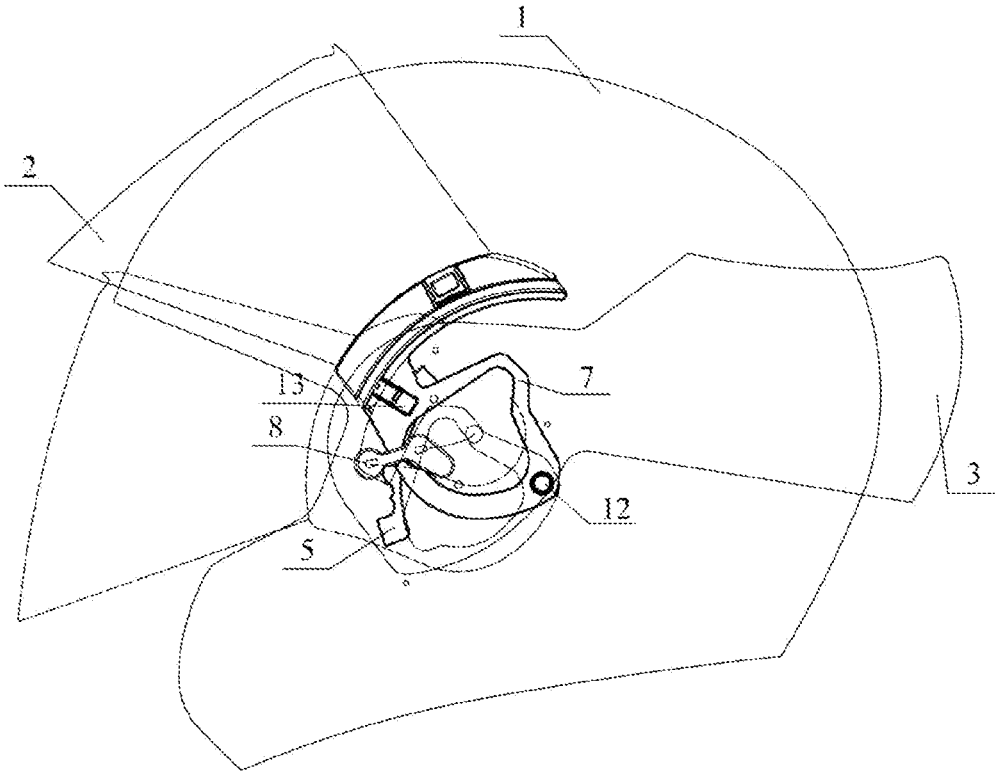
FIG. 14 is a structural side view of the helmet shown in FIG. 8 in a state of causing the face mask to be raised to a limiting condition and the chin guard to be raised upwardly to a limiting condition when the chin guard rotation guide is removed.

As shown in FIGS. 5-7, the mounting grooves 4 of the connecting assembly are symmetrically arranged on two sides of the helmet body 1, so that the connecting assembly can be hidden inside the helmet body 1, the appearance of the helmet body 1 is more attractive; and meanwhile, the connecting assembly can be prevented from being exposed to the outside of the helmet body to easily damage the connecting assembly and the like.

Figure 2:
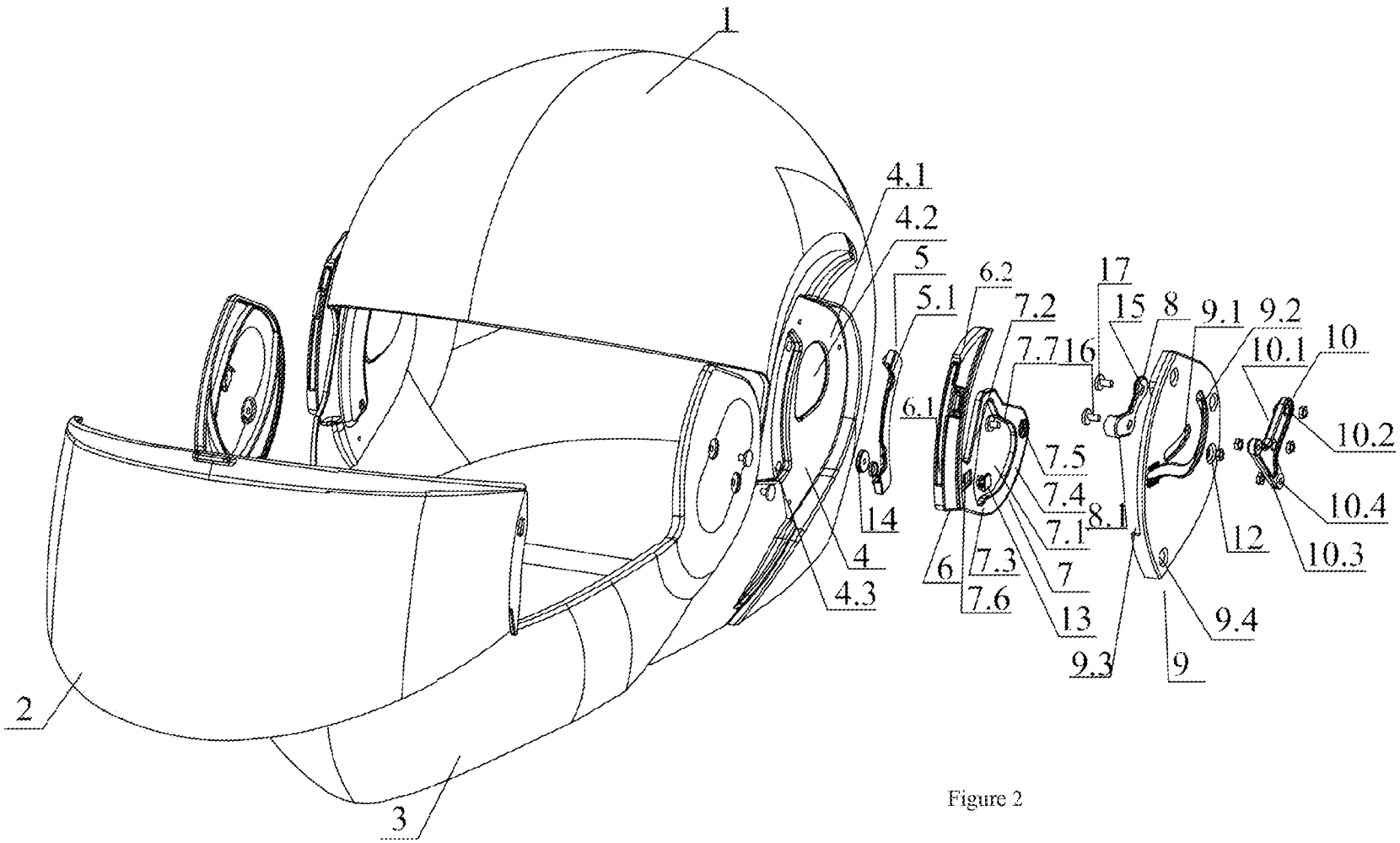
FIG. 2 is a partially explosive structure view of FIG. 1.
Figure 3:
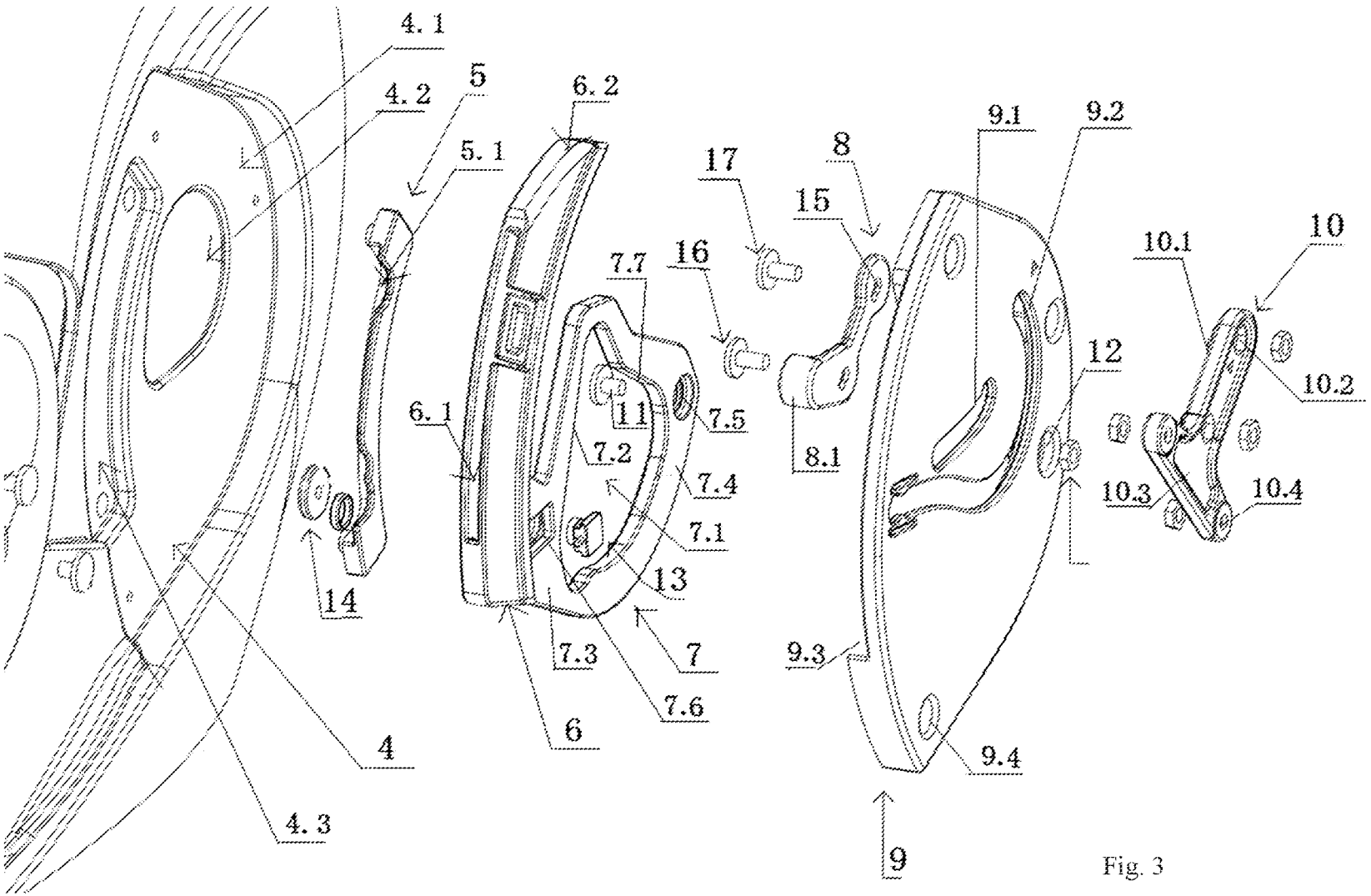
FIG. 3 is a partially enlarged structure view of FIG. 2.
Figure 4:
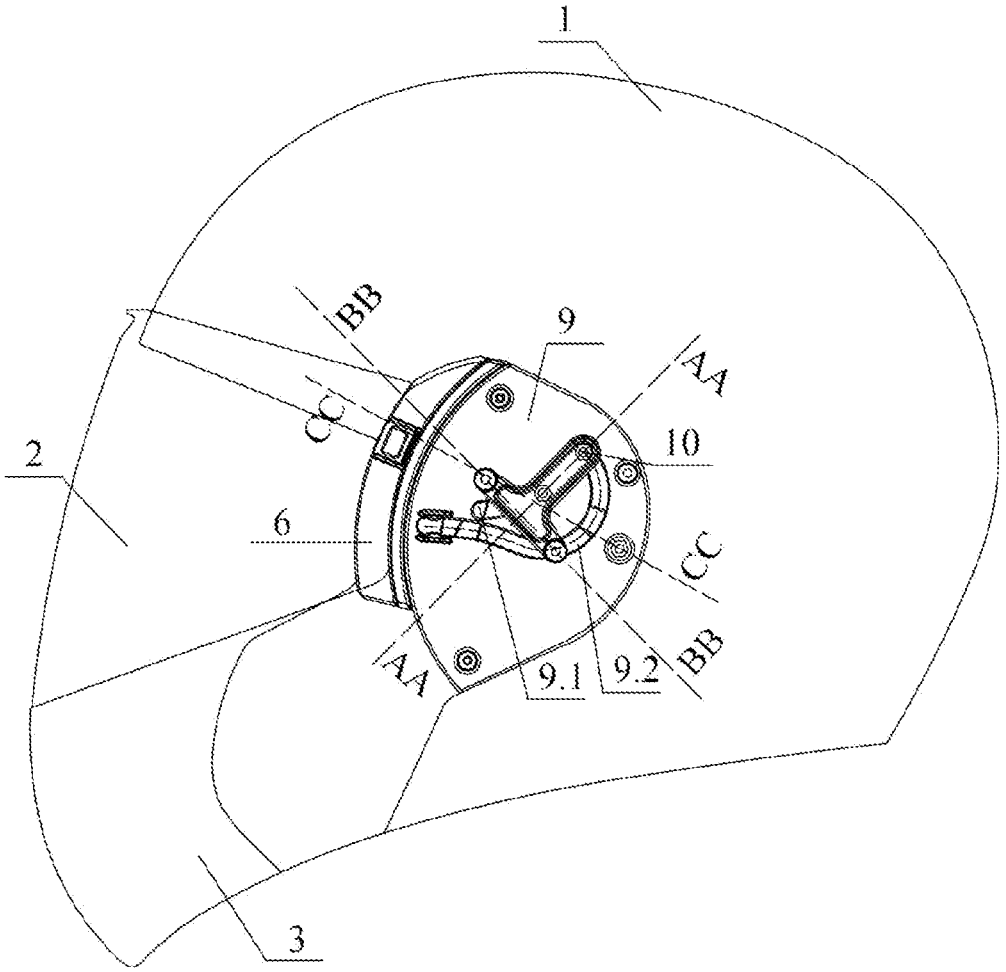
FIG. 4 is a structural side view of FIG. 1 with the chin guard removed.

As shown in FIGS. 2 and 3, the face mask rotation limiter 5 is mainly used for limiting the upward and downward rotation limit positions of the face mask 2; and when the face mask 2 rotates to reach the limit position, the face mask 2 cannot continue to rotate upwardly or downwardly under the blocking of the face mask rotation limiter 5.

As shown in FIGS. 2 and 3, the face mask mount 6 is used for being connected with the face mask 2. Of course, the face mask mount 6 and the face mask 2 can be manufactured into an integral structure, but the structure will certainly enlarge the structural size of the face mask body, increase the volume and processing difficulty of molds for manufacturing the face mask, and enable the face mask mount 6 and the face mask 2 to be manufactured into a separated structure, so that the face mask is manufactured and replaced conveniently.

As shown in FIGS. 2 and 3, the linkage guide annular piece 7 is a key component for the linkage between the face mask 2 and the chin guard 3, and can be made as an integrate structural member with the face mask 2 mount or as a separated structure with the face mask mount 6 and then assembled as an integrate structural member.

As shown in FIGS. 2 and 3, the inner annular surface in the linkage guide annular piece 7 is an inner annular surface matched with the driving end 8.1 of the driving rod 8, the inner annular surface being of a D-shaped structure. Driving shafts (a first driving shaft 16 and a second driving shaft 17) are respectively arranged at two ends of the driving rod 8, the two driving shafts respectively pass through two guide grooves (a first guide groove 9.1 and a second guide groove 9.2) on the chin guard rotation guide 9, then the two driving shafts are connected with the chin guard mount 10, and the chin guard mount 10 is connected with the end of the chin guard 3. A rotation center 12 of the linkage guide annular piece is arranged on the annular surface of the linkage guide annular piece 7, a first through hole 7.5 is formed in the rotation center 12, and the linkage guide annular piece 7 is connected with the side of the chin guard rotation guide 9 or the side of the mounting groove 4 by the first rotating shaft 11 passing through the first through hole 7.5. The chin guard rotation guide 9 is connected with the side of the mounting groove 4 arranged on the helmet body 1 by a screw connector. That is, the position with the first rotating shaft 11 as the rotation center 12 is fixed with respect to the helmet body 1, and the linkage guide annular piece 7 swings around the first rotating shaft 11 as the rotation center 12, that is, the face mask 2 swings around the first rotating shaft 11 as the rotation center 12.

As shown in FIGS. 2 and 3, however, when the linkage guide annular piece 7 swings about this rotation center 12 of the first rotating shaft 11, an swinging motion is achieved under the driving of the driving end 8.1 of the driving rod 8. Two rotating shafts (a first driving shaft 16 and a second driving shaft 17) are respectively arranged at two ends of the driving rod 8, and the two rotating shafts respectively slide in two guide grooves (a first guide groove 9.1 and a second guide groove 9.2) on the chin guard rotation guide 9, namely the rotation centers of the two rotating shafts on the driving rod 8 are not fixed, but variable track type rotation center with sliding displacement in the two guide grooves; that is, the motion trajectory of the driving end 8.1 of the driving rod 8 is constrained by the rotation center 12 of the first rotating shaft 11 on the linkage guide annular piece 7, also constrained by the rotation centers of the two guide grooves (variable tracks), and is also related to the shape of the inner annular surface of the linkage guide annular piece 7.

The specific process by which the driving end 8.1 of the driving rod 8 drives the linkage guide annular piece 7 to swing and to drive the rotation of the face mask 2 is that, as shown in FIGS. 2, 3 and 8-14, both the face mask 2 and the chin guard 3 are in their original positions in a state protecting the face and chin. The driving end 8.1 of the driving rod 8 is located at an upper end of the vertical edge 7.2 of the D-shaped inner annular surface of the linkage guide annular piece 7. When the chin guard 3 starts to be raised upwardly, the end of the chin guard 3 passes through a chin guard connector 10 connected therewith and two rotating shafts (a first driving shaft 16 and a second driving shaft 17) connected with the chin guard connector 10; and the two rotating shafts pass through the two guide grooves (a first guide groove 9.1 and a second guide groove 9.2) on the chin guard rotation guide 9 and are then connected with the two ends of the driving rod 8, so that the driving end 8.1 of the driving rod 8 starts to drive the linkage guide annular piece 7, the linkage guide annular piece 7 is driven from the upper end of the D-shaped arc-shaped surface 7.7 to rotate clockwise along the D-shaped inner annular surface around the rotation center 12 of the first rotating shaft 11; at this time, the chin guard 3 can drive the face mask 2 to rotate upwardly and clockwise together. After the chin guard 3 drives the face mask 2 to rotate until the lower edge of the face mask 2 slightly exceeds the edge of the front end of the helmet body 1, the driving end 8.1 of the driving rod 8 has also driven the linkage guide annular piece 7 to rotate clockwise about the rotation center 12 of the first rotating shaft to the lower end of the D-shaped arc-shaped surface 7.7. During the process that the linkage guide annular piece 7 starts from the upper end of the D-shaped arc-shaped surface 7.7 of the drive linkage guide annular piece 7 until rotates clockwise about the rotation center 12 of the first shaft 11 to the lower end of the D-shaped arc-shaped surface 7.7, the driving end 8.1 of the driving rod 8 passes through the first shaft 16 of the driving end 8.1 of the driving rod 8 to reach the upper end of the first guide groove 9.1 in the two guide grooves located on the guard rotation guide 9; and the second rotating shaft 17 passing through the other end of the driving rod 8 is rotated from the upper end of the second guide groove 9.2 in the two guide grooves on the guard rotation guide 9 to a middle part of the second guide groove.

Figure 15:
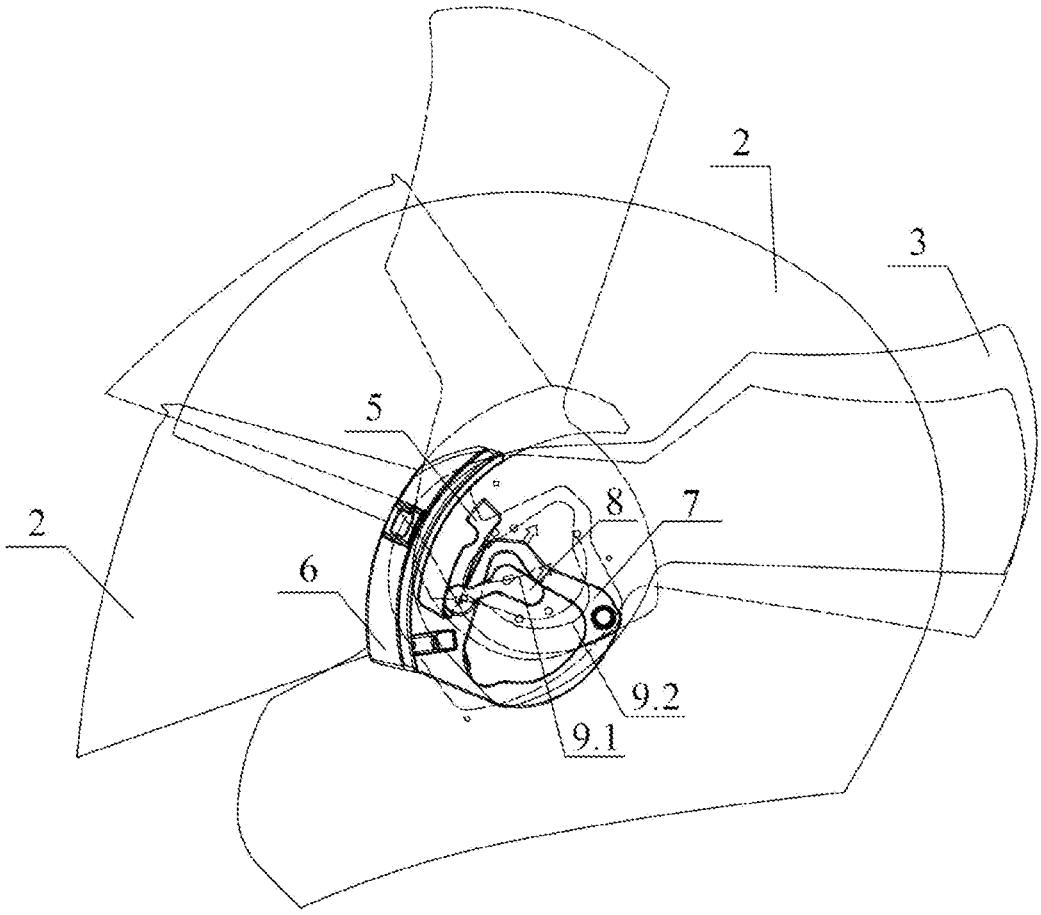
FIG. 15 is a structural side view of the helmet in the state of FIG. 14 with the face mask and chin guard initially returned to the initial state.

As shown in FIGS. 2, 3 and 15, when the chin guard 3 continues to rotate clockwise upwardly and backwardly, the driving end 8.1 of the driving rod 8 is driven by the chin guard 3, the chin guard connector 10, the rotating shaft and the driving rod 8, so that the driving end 8.1 of the driving rod 8 moves from the lower end to the upper end of the vertical edge 7.2 of the D-shaped inner annular surface of the linkage guide annular piece 7. As the driving end 8.1 of the driving rod 8 is now moved along the vertical edge 7.2 of the D-shaped inner annular surface of the linkage guide annular piece 7, the linkage guide annular piece 7 cannot be driven to rotate about the rotation center 12 of the first rotating shaft 11, the chin guard 3 continues to rotate clockwise upwardly and backwardly, and the face mask 2 will no longer rotate clockwise upwardly and backwardly during this period. The chin guard may continue to rotate the middle part of the rear face of the helmet body 1 clockwise upwardly and backwardly. Because the end of the chin guard 3 is driven by the chin guard 3, the chin guard connector 10, the rotating shaft and the driving rod 3, the driving end 8.1 of the driving rod 8 moves from the lower end to the upper end of the vertical edge 7.2 of the D-shaped inner annular surface of the linkage guide annular piece 7, and then the first driving shaft 16 passing through the driving end 8.1 of the driving rod 8 is transferred from the upper end of the first guide groove 9.1 in the two guide grooves located on the guard rotation guide 9 to the lower end of the first guide groove 9.1; and the second driving shaft 17 passing through the other end of the driving rod 8 is rotated from the middle part of the second guide groove 9.2 in the two guide grooves on the guard rotation guide 9 to the lower end of the second guide groove 9.2.

As shown in FIGS. 2 and 3, a second through hole 7.6 is also provided on the annular surface of the linkage guide annular piece 7, a second rotating shaft 13 is arranged in the second through hole 7.6, one end of the second rotating shaft 13 passes through the annular edge 7.4 of the linkage guide annular piece 7 and extends to the face mask rotation limiter 5, and a guide roller 14 is installed at the end of the second rotating shaft 13; and the guide roller 14 is matched with a tooth-shaped arc-shaped limiting guide groove on the face mask rotation limiter 5 to limit the face mask 2. In order to enable the guide roller 14 and the tooth-shaped arc-shaped limiting guide groove to be always kept in a press fit state, the second through hole 7.6 is a hourglass-shaped through hole, and a third rotating shaft and a spring (not shown) for pressing the second rotating shaft are arranged in the hourglass-shaped through hole.

As shown in FIG. 15, after the chin guard 3 is rotated to the middle of the rear face of the helmet body 1, the face mask can be pulled down and reset. During the process that the chin guard 3 is rotated upwardly and forwardly from the rear face of the helmet body 1 until it is rotated to the lower edge of the chin guard 3 and close to the edge of the front face of the helmet body 1, the driving end 8.1 of the driving rod 8 drives the D-shaped inner annular surface of the linkage guide annular piece 7, and then moves from the upper end to the lower end of the D-shaped arc-shaped surface 7.7. At this time, the linkage guide annular piece 7 rotates clockwise about the rotation center 12 of the first rotating shaft 11, and thus the face mask will rotate therewith. After the lower edge of the face mask 2 rotates slightly beyond the edge of the front face of the helmet body 1, the driving end 8.1 of the driving rod 8 drives the D-shaped arc-shaped surface 7.7 of the linkage guide annular piece 7 and moves from the upper end to the lower end of the straight edge 7.2 of the D-shaped inner annular surface. At this time, the linkage guide annular piece 7 does not rotate clockwise about the rotation center 12 of the first rotating shaft 11, and therefore the face mask 2 will not rotate therewith. Meanwhile, the first rotating shaft 16 passing through the driving end 8.1 of the driving rod 8 is also upwardly transferred to the upper end from the lower end of the first guide groove 9.1 in the two guide grooves on the guard rotation guide 9, while the second rotating shaft 17 passing through the other end of the driving rod 8 is also upwardly transferred to the middle part from the lower end of the second guide groove 9.2 in the two guide grooves on the guard rotation guide 9. When the chin guard 3 is rotated backwardly, downwardly, forwardly and upwardly in this process, it is first necessary to raise the face mask 2, which has been pulled down, upwards to the limiting position of pull-up, i.e. the chin guard 2 is rotated anticlockwise upwardly, and the face mask 2 is rotated clockwise upwardly; and after the chin guard 3 coincides with the face mask 2, it is then rotated anticlockwise downwardly and forwardly together with the chin guard 3.

As shown in FIG. 15, when the chin guard 3 continues to rotate downwardly and forwardly, the driving end 8.1 of the driving rod 8 continues to drive the D-shaped inner annular surface of the linkage guide annular piece 7, and then rotates towards the upper end of the arc segment from the lower end of the D-shaped arc-shaped surface 7.7 of the linkage guide annular piece 7. At this time, the driving end 8.1 of the driving rod 8 will drive the linkage guide annular piece 7 to start rotating anticlockwise about the rotation center 12 of the first rotating shaft 11. If the face mask 2 has been pulled down, it will first return to an upwardly raised condition under the action of the driving end 8.1 of the driving rod 8 and will then be reset to the initial protected condition together with the chin guard 3. During the process, the first rotating shaft 16 passing through the driving end 8.1 of the driving rod 8 returns to the upper end of the first guide groove 9.1 in the two guide grooves on the guard rotating guide 9 and remains stationary. At the same time, the second rotating shaft 17 passing through the other end of the driving rod 8 is transferred upwardly to the upper end and reset from the middle part of the second guide groove 9.2 in the two guide grooves on the guard rotating guide 9.

The mentioned above is only preferred embodiments of the invention. It should be noted that several modifications and adaptations may be made by those skilled in the art without departing from the technical principles of the present invention, and such modifications and adaptations are to be considered within the scope of the invention.

The invention claimed is:

1. A helmet with a chin guard and a face mask that have associated rotations, comprising a helmet body, wherein each of the face mask and the chin guard is hinged respectively on two side surfaces of the helmet body by two connecting assemblies respectively, mounting grooves of the connecting assembly are provided with a face mask rotation limiter in the connecting assembly, a face mask mount, a linkage guide annular piece connected with the face mask mount, a driving rod matched with an annular groove on the linkage guide annular piece, a chin guard mount connected with the driving rod via a first driving shaft and a second driving shaft, and a chin guard rotation guide clamped on the driving rod and the chin guard mount, wherein a double-track guide groove for guiding the rotation of the chin guard is formed in the chin guard rotation guide, the the first driving shaft and the second driving shaft provided at two ends of the driving rod respectively passing through the double-track guide groove and being connected with the chin guard mount; wherein the face mask rotation limiter is mounted on the mounting groove, and the linkage guide annular piece is hinged with the chin guard rotation guide by a first rotating shaft; and wherein the chin guard rotation guide is connected with the mounting groove, a face mask rotation limiting guide groove is provided on the face mask rotation limiter, and a limiting guide piece matched with the limiting guide groove is further provided on the linkage guide annular piece.

2. The helmet according to claim 1, wherein the mounting grooves are grooves which are symmetrically arranged on two sides of the helmet body and are respectively concave inwards; the mounting grooves of the connecting assembly have a stepped groove structure and are divided into three layers including a face mask rotation limiter mounting groove located in a third layer, a chin guard rotation guide mounting groove located in a first layer, and a groove for defining motion range of a driving end of the driving rod located in a second layer respectively; and the shape of the face mask rotation limiter mounting groove is matched with that of the face mask rotation limiter, the shape of the chin guard rotation guide mounting groove is matched with that of the chin guard rotation guide, and the shape of the groove for defining motion range of a driving end of the driving rod is matched with the motion range of the driving end of the driving rod.

3. The helmet according to claim 2, wherein the face mask rotation limiter is an arc-shaped strip piece, an inner arc-shaped surface of the arc-shaped strip piece is an arc-shaped surface, an outer arc-shaped surface of the arc-shaped strip piece is an arc-shaped surface provided with a limiting guide groove, and a plurality of segments of arc-shaped grooves with different curvature radii are arranged on the arc-shaped surface provided with the limiting guide groove to form a tooth-shaped arc-shaped limiting guide groove; and the face mask rotation limiter has a shell structure, connectors are pre-embedded in two ends of the arc-shaped strip piece at one side of a cavity of the shell, and the arc-shaped strip piece enables one side of the cavity of the shell to face towards the mounting groove of the face mask rotation limiter on the helmet body.

4. The helmet according to claim 3, wherein the linkage guide annular piece has a D-shaped annular structure, the side of a straight edge of the linkage guide annular piece with the D-shaped annular structure corresponds to the side of an inner arc-shaped surface of the strip-shaped arc-shaped surface, and a connecting part is arranged between the side of the straight edge of the linkage guide annular piece and the side of the inner arc-shaped surface of the strip-shaped arc-shaped surface; and a first through hole is formed in one side of the annular edge of the D-shaped linkage guide annular piece, the first rotating shaft hinged with the chin guard rotation guide is arranged in the first through hole, and the linkage guide annular piece swings around the first rotating shaft under the driving of the driving end of the driving rod.

5. The helmet according to claim 4, wherein a second through hole is further formed in the side of the straight edge of the D-shaped linkage guide annular piece, a second rotating shaft is arranged in the second through hole, one end of the second rotating shaft is in sliding fit with one side of the second through hole, and the other end of the second rotating shaft extends out of one side of the D-shaped linkage guide annular piece; and the other end of the second rotating shaft is provided with a guide roller matched with the tooth-shaped arc-shaped limiting guide groove, the second through hole is a hourglass-shaped long hole formed along a radial direction of the strip-shaped arc-shaped surface of the face mask mount, a spring used for pressing the second rotating shaft is arranged in the hourglass-shaped long hole, and the spring is used for enabling the guide roller to be always press-fitted with the tooth-shaped arc-shaped limiting guide groove.

6. The helmet according to claim 1, wherein the face mask mount has a strip-shaped arc-shaped surface structure, the side of an outer arc-shaped surface of the strip-shaped arc-shaped surface is used for being connected with the face mask, the side of an inner arc-shaped surface of the strip-shaped arc-shaped surface is used for being connected with a linkage guide annular piece, or the side of an inner arc-shaped surface of the strip-shaped arc-shaped surface and the linkage guide annular piece form an integral structure; and the strip-shaped arc-shaped surface is provided with at least one of a slot and a convex edge on the side of the outer arc-shaped surface used for being connected with the face mask, and the width of the strip-shaped arc-shaped surface is greater than that of the linkage guide annular piece.

7. The helmet according to claim 1, wherein the driving rod has an elongated rod-shaped structure and is arranged between the linkage guide annular piece and the chin guard rotation guide, a driving end of the driving rod for being matched with an inner ring of the linkage guide annular piece is arranged at one end of the elongated rod-shaped driving rod, and the other end of the driving rod is located outside the linkage guide annular piece; and each of two ends of the driving rod is provided with a shaft hole that passes through the driving rod, the first driving shaft and the second driving shaft are respectively arranged in the two shaft holes, the first driving shaft passes through the shaft hole at the driving end of the driving rod, and the second driving shaft passes through the shaft hole at the other end of the driving rod.

8. The helmet according to claim 7, wherein the chin guard rotation guide has a structure of a D-shaped shell, a through double-track guide groove is formed in the D-shaped shell, and a first guide groove in the through double-track guide groove is in sliding fit with the first driving shaft passing through the shaft hole at the driving end of the driving rod, and a second guide groove in the through double-track guide groove is in sliding fit with the second driving shaft passing through the shaft hole at the other end of the driving rod; the first guide groove and the second guide groove are arc-shaped grooves which are arranged in a front-back and inclined manner, the groove length of the second guide groove is twice or more than that of the first guide groove, and a side sliding groove which is in sliding fit with the driving rod is arranged on an edge of the side of a straight edge segment of the D-shaped shell; and the D-shaped shell is also provided with a mounting hole of the chin guard rotation guide and a mounting hole at one end of the first rotating shaft.

9. The helmet according to claim 8, wherein the chin guard mount is a T-shaped structural member and arranged on the outer side of the chin guard rotation guide; rotating shaft mounting holes of the first driving shaft and the second driving shaft are formed in a vertical segment of the T-shaped structural member, and a fixed mounting hole of the chin guard is formed in a transverse segment of the T-shaped structural member; and the ends of the first driving shaft and the second driving shaft pass through the rotating shaft mounting holes and are connected with the chin guard mount, and the chin guard is connected with the chin guard mount through the fixed mounting hole via a fastening piece or the clamping piece.

10. The helmet according to claim 9, wherein the helmet body, the face mask, the chin guard, the face mask rotation limiter, the face mask mount, the linkage guide annular piece, the driving rod, the chin guard rotation guide and the chin guard mount are injection-molded or compression-molded from a high polymer material.

11. The helmet according to claim 1, wherein the helmet body, the face mask, the chin guard, the face mask rotation limiter, the face mask mount, the linkage guide annular piece, the driving rod, the chin guard rotation guide and the chin guard mount are injection-molded or compression-molded from a high polymer material.

* * * * *